US008793816B2

(12) United States Patent
Emrich et al.

(10) Patent No.: US 8,793,816 B2
(45) Date of Patent: Aug. 5, 2014

(54) PROTECTIVE HEADPIECE

(75) Inventors: Bryan Emrich, Naperville, IL (US); John Larkin, Moscow, ID (US); Frederick Mariani, Newport, KY (US); William Rempe, Loveland, OH (US)

(73) Assignee: Hoplite Armour LLC, Naperville, IL (US)

( * ) Notice: Subject to any disclaimer, the term of this patent is extended or adjusted under 35 U.S.C. 154(b) by 13 days.

(21) Appl. No.: 13/370,502

(22) Filed: Feb. 10, 2012

(65) Prior Publication Data

US 2012/0204328 A1 Aug. 16, 2012

Related U.S. Application Data

(60) Provisional application No. 61/477,757, filed on Apr. 21, 2011, provisional application No. 61/441,889, filed on Feb. 11, 2011.

(51) Int. Cl.
*A63B 71/10* (2006.01)
*A42B 3/18* (2006.01)

(52) U.S. Cl.
CPC ..... *A42B 3/18* (2013.01)
USPC ..... 2/425; 2/410; 2/414; 2/420; 2/421; 2/424

(58) Field of Classification Search
CPC ..... A42B 3/145; A42B 3/328; A42B 3/062; A42B 3/20
USPC ..... 2/411, 9, 424, 425, 10, 414, 420, 410, 2/417, 418, 421
See application file for complete search history.

(56) References Cited

U.S. PATENT DOCUMENTS

| | | | | |
|---|---|---|---|---|
| 3,373,443 | A | | 3/1968 | Marietta |
| 3,984,875 | A | | 10/1976 | Farquharson |
| 4,051,555 | A | * | 10/1977 | Daly ..... 2/412 |
| 4,083,065 | A | | 4/1978 | Warncke |
| 4,223,229 | A | | 9/1980 | Persico |
| 4,282,610 | A | * | 8/1981 | Steigerwald et al. ..... 2/414 |
| 4,677,694 | A | | 7/1987 | Crow |
| 4,885,806 | A | | 12/1989 | Heller |
| 4,933,993 | A | | 6/1990 | McClelland |
| 5,157,794 | A | | 10/1992 | Kamata |
| D332,672 | S | | 1/1993 | Abate |
| 5,263,204 | A | | 11/1993 | Butsch |

(Continued)

FOREIGN PATENT DOCUMENTS

CA 2 155061 7/1995

*Primary Examiner* — Danny Worrell
*Assistant Examiner* — Khaled Annis
(74) *Attorney, Agent, or Firm* — Cook Alex Ltd.

(57) ABSTRACT

The present disclosure relates to a protective headpiece for an athlete of a game using a projectile to protect at least a portion of the brow, temple and jaw of the athlete's head against impacts by the projectile. The protective head piece is releasably securable to the athlete's head and includes a mask portion comprising an impact resistant material. The mask portion includes a brow portion adapted to substantially shield the athlete's brow area and having opposed sides. A temple portion is positioned at each side of the brow portion and adapted to substantially shield the athlete's temple areas. The mask portion also includes a jaw portion extending from each of the temple portions and adapted to substantially shield at least the athlete's lower jaw. The jaw portion includes a front portion which defines an opening sized to permit frontal viewing of the athlete's mouth.

20 Claims, 16 Drawing Sheets

(56) References Cited

U.S. PATENT DOCUMENTS

| | | | | |
|---|---|---|---|---|
| 5,267,353 | A | 12/1993 | Milligan | |
| 5,384,914 | A | 1/1995 | Caveness | |
| D366,539 | S | 1/1996 | Lackovic | |
| 5,535,454 | A | 7/1996 | Ryan | |
| 5,571,220 | A | 11/1996 | Hall | |
| 5,657,492 | A | 8/1997 | Esposito, Jr. | |
| 5,661,849 | A | 9/1997 | Hicks | |
| 5,666,670 | A | 9/1997 | Ryan | |
| 5,911,308 | A * | 6/1999 | Chafitz et al. | 2/9 |
| 5,953,761 | A * | 9/1999 | Jurga et al. | 2/425 |
| 5,966,744 | A | 10/1999 | Smith, Jr. | |
| 6,189,156 | B1 * | 2/2001 | Loiars | 2/424 |
| 6,202,223 | B1 * | 3/2001 | Chartrand | 2/410 |
| D448,528 | S | 9/2001 | Fujimoto | |
| 6,584,614 | B2 | 7/2003 | Hogg | |
| 6,708,339 | B1 | 3/2004 | Smith, Jr. | |
| 6,931,664 | B1 * | 8/2005 | Chen | 2/9 |
| 6,938,272 | B1 * | 9/2005 | Brown | 2/9 |
| 6,983,487 | B2 | 1/2006 | Rickon | |
| D548,893 | S | 8/2007 | Hedge | |
| D549,883 | S | 8/2007 | Dion | |
| 7,735,157 | B2 | 6/2010 | Ikeda | |
| 7,814,577 | B2 | 10/2010 | Page | |
| 7,954,177 | B2 * | 6/2011 | Ide et al. | 2/425 |
| 2007/0011797 | A1 | 1/2007 | Ikeda | |
| 2007/0192946 | A1 * | 8/2007 | Wright | 2/424 |
| 2009/0031484 | A1 * | 2/2009 | Broersma et al. | 2/424 |
| 2009/0113606 | A1 * | 5/2009 | Jourde et al. | 2/421 |

* cited by examiner

PROTECTIVE HEADPIECE

CROSS REFERENCE TO RELATED APPLICATIONS

This application claims the benefit of the filing date of U.S. Provisional Appln. Ser. No. 61/477,757, filed Apr. 21, 2011, and the benefit of the filing date of U.S. Provisional Appln. Ser. No. 61/441,889 filed Feb. 11, 2011, the entire contents of which are incorporated by reference herein.

FIELD OF THE DISCLOSURE

The present disclosure is related generally to protective headpieces, particularly for athletes of games using projectiles. More particularly, the present disclosure relates to, but is not exclusive to, protective headpieces that may be worn by baseball or softball batters or fielders. The present disclosure also relates to the method of making such protective head pieces.

BACKGROUND

For many years protective equipment and more specifically protective head equipment such as helmets have been utilized to protect athletes of a variety of sports from head injuries. Protective head equipment is commonly used by athletes of a variety of sports involving projectiles such as balls, pucks, bats, and sticks. Protective head equipment of this type is particularly important to safeguard the well-being of the athletes and more importantly young athletes who are less experienced, and therefore more likely to make a mistake while participating in a sport that could result in very serious injury without some form of protection. Recently, in part due to increased media attention given to severe head injuries, significant consideration has been given to head protection for athletes.

Protective head equipment is particularly important for use by athletes in the game of baseball and softball. Today, almost all batters and catchers are wearing some sort of equipment to protect against head injury from, for example, a thrown or batted ball. Unfortunately from the number of injuries, the potential for serious and even deadly head injuries resulting from a thrown or batted ball are well understood but still have not be sufficiently addressed. Specifically, there are a growing number of head and brain injuries caused when batted or thrown baseballs or softballs strike a fielder or batter in the head. For example, pitched ball speeds of over 90 mph have been recorded at the high school level. The high speed of pitched balls in conjunction with the number of pitched balls thrown during a game lead to a high probability that a batter can be struck in the head and more particularly face. The vulnerability is increased when the batter is not wearing face protection. The result of the impact of the ball to a batter's head can result in broken bones, injured eyes, broken teeth and potentially even more serious trauma to the batter's head.

Conventional protective head equipment worn by batters typically does not protect the face of the batter. The protective head equipment typically includes a bulky unitary hard helmet structure that covers at least the crown, top, and rear of the athlete's head and also has side flaps that covers the sides of the athlete's head. In some instances, various face guards are attached to the helmet so as to provide a cage or grid of rigid bars that pass across the player's face which are secured to the opposing sides of the helmet. Unfortunately, many baseball or softball players above the age of 9 do not wear full face protection due to the weight and unappealing design of these face guards.

This conventional protective head equipment with or without a facemask does not accommodate for the movements and activities performed by a batter while playing offense (hitting, running, sliding, etc.) or for fielders while playing defense. For example, batters and base runners are at risk that a thrown or batted ball could strike them in the head and more particularly the face while they are moving between bases. In addition, when wearing conventional helmets, a base runner's face is exposed and is therefore vulnerable to contact with the defensive player. For example, the runner's face may contact the defensive player's knee or elbow or the spikes on the bottom of a defensive player's shoes when the base runner is sliding into a base. Further, the vision apertures of conventional helmets typically include bars, which obstruct the athlete's view. Additionally, current batting helmets that include facemasks are often bulky and heavy and therefore unstable on an athlete's head. This conventional equipment is simply just too bulky and limiting for baseball batters to optimize their play and safety while playing offense.

SUMMARY

In a first aspect, the present disclosure relates to a protective headpiece for an athlete of a game using a projectile to protect at least a portion of the brow, temple and jaw of the athlete's head against impacts by the projectile. The protective head piece which is releasably securable to the athlete's head includes a mask portion comprising an impact resistant material. The mask portion includes a brow portion adapted to substantially shield the athlete's brow area and having opposed sides. A temple portion is positioned at each side of the brow portion and adapted to substantially shield the athlete's temple areas. The mask portion also includes a jaw portion extending from each of the temple portions and adapted to substantially shield at least the athlete's lower jaw. The jaw portion includes a front portion which defines an opening sized to permit frontal viewing of the athlete's mouth. Together the brow, jaw and temple portions defining a substantially open vision aperture sized to provide the athlete with a substantially unobstructed forward and peripheral vision. The headpiece also includes a retainer secured to the mask and configured to removably retain the mask potion on the athlete's head.

In another aspect, the present disclosure relates to a modular protective headpiece for an athlete of a game using a projectile to protect the athlete's head against impacts by the projectile. The modular protective head piece includes a helmet portion with at least a crown member adapted to substantially protect a top and, if desired, the back surface of the athlete's head, and a mask portion adapted to substantially shield the athlete's brow, temple and lower jaw. The helmet portion is removably attachable to the mask portion. "Protecting" or "shielding" as used herein, refers generally to enhancing safety in the event of a projectile impact, and does not mean ensuring that no injury can occur. Also, certain areas of the headpiece may be afforded greater impact resistance, such as frontal or facial or temple areas, than other areas where impact is less likely or less of a concern, as may be reflected in safety standards.

In yet another aspect, the present disclosure relates to a method of making a modular head piece for an athlete of a game using a projectile. The head piece has a first mode that substantially protects only the face of the athlete and a second mode that substantially protects the face and crown of an athlete. The method includes the step of providing a mask portion adapted to substantially shield the athlete's brow, temple and lower jaw. Another step of the method includes providing a helmet portion having at least a crown member adapted to substantially protect at least a top surface of the athlete's head. Yet another step of the method is positioning and securing the mask portion over the athlete's face to configure the head piece in the first mode. Still yet another step is attaching the helmet portion to the mask portion to configure the head piece in the second mode and whereby the athlete can selectively remove the helmet portion without disturbing the mask portion to configure the headpiece in the first mode.

BRIEF DESCRIPTION OF THE FIGURES

In the course of this description, reference will be made to the accompanying drawing(s), wherein.

Figure 1:
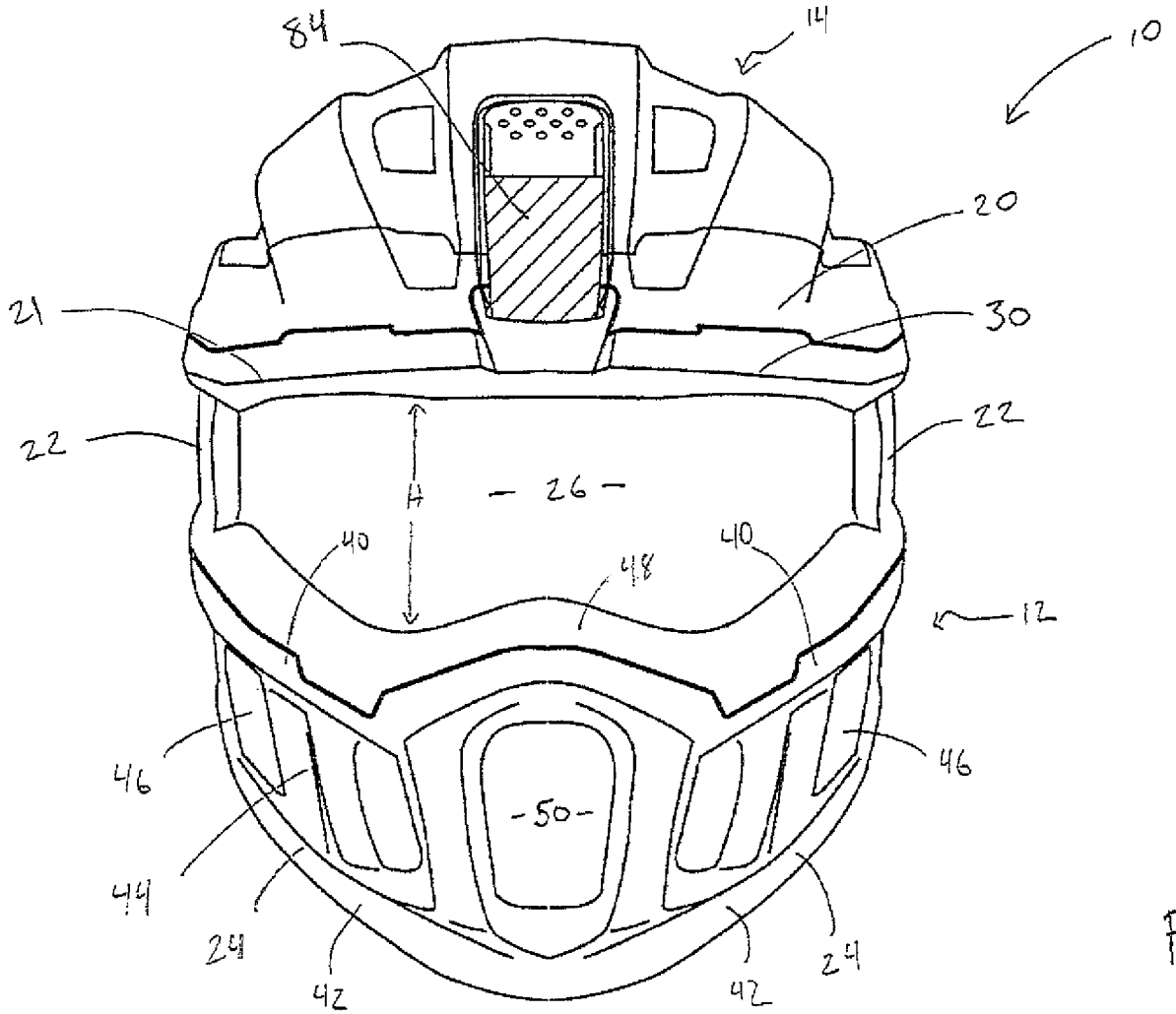
FIG. 1 is a front view of one embodiment of a protective headpiece accordance with the present disclosure.
Figure 2:
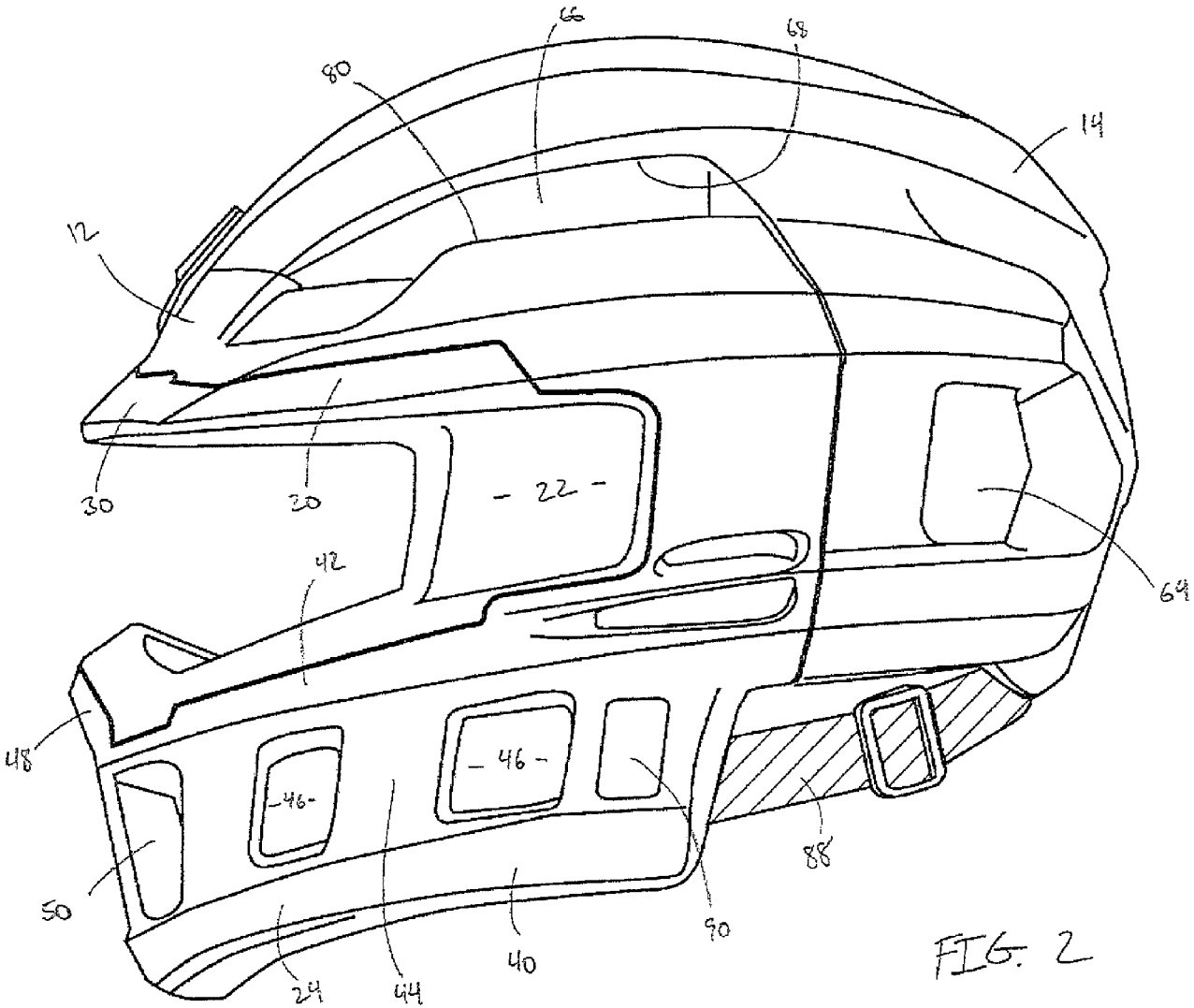
FIG. 2 is a side view of the headpiece of FIG. 1.
Figure 3:
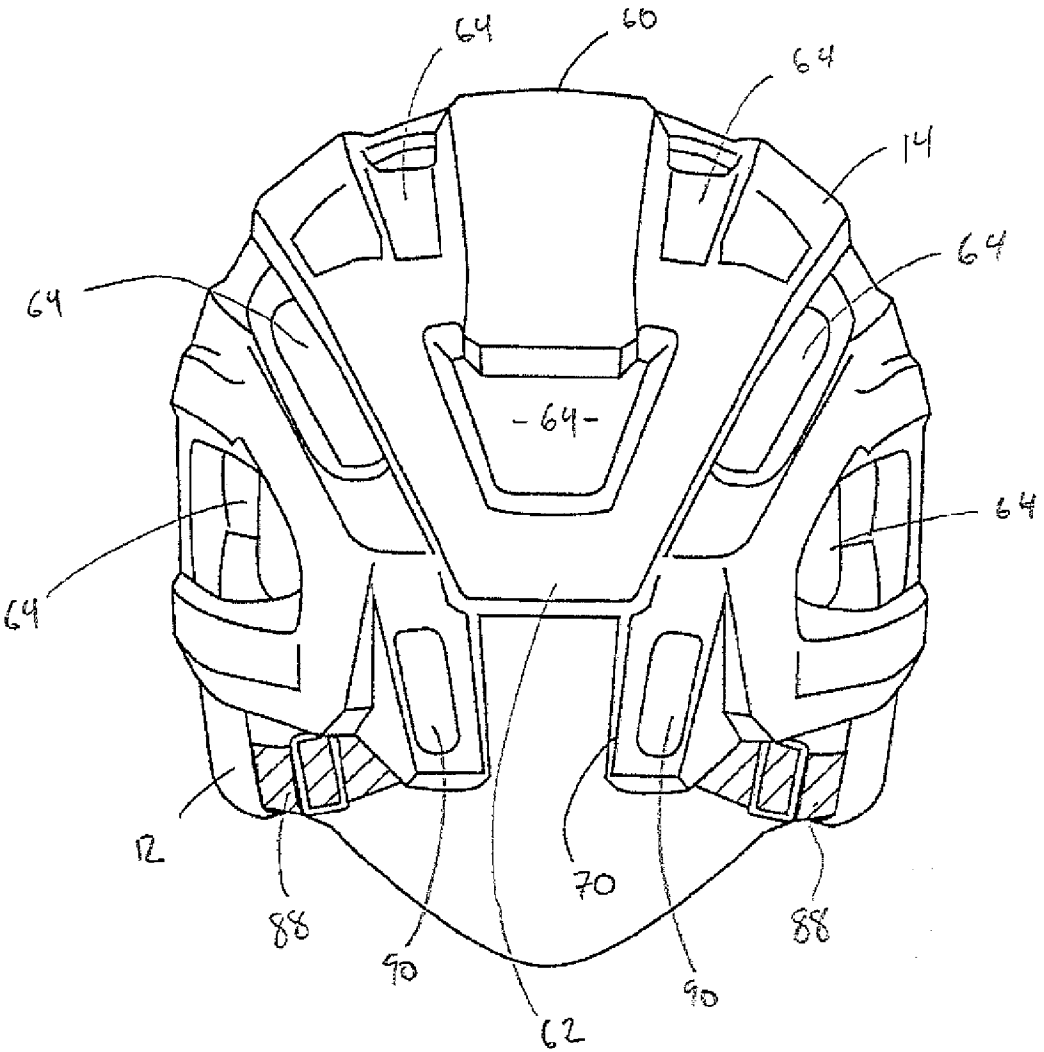
FIG. 3 is a rear view of the headpiece of FIG. 1.

Corresponding reference numerals indicate corresponding parts throughout the several views. Although the drawings represent exemplary embodiments of the present disclosure, the drawings are not necessarily to scale and certain features may be exaggerated to better illustrate and explain the present disclosure.

DETAILED DESCRIPTION

Detailed embodiments of the present subject matter are disclosed herein; however, it will be understood that the disclosed embodiments are merely exemplary, and may be embodied in various forms. Therefore, specific details disclosed herein are not to be interpreted as limiting, but as illustrative of various aspects of the present subject matter.

As described in more detail below, this description is directed to protective headpieces such as for athletes of games, particularly games using projectiles. Referring now to the figures, illustrated are various configurations of a protective headpiece 10 which is to be worn by an athlete. The headpiece 10, which is preferably modular, includes a separate mask portion 12 and a helmet portion 14. The preferred modular headpiece can be worn in a first mode that substantially protects only the face of the athlete (including adjacent areas, such as the temple) (see FIGS. 7 and 8) and a second mode that protects to some degree the entire head of the athlete (the amount of protection may vary for different portions of the head) (FIGS. 1-6). When the headpiece 10 is worn in the first mode, the athlete is only wearing the mask portion 12 and when the headpiece 10 is in the second mode, the athlete is wearing the mask portion 12 and helmet portion 14. In the illustrated embodiment, the athlete can selectively add or remove the helmet portion to configure the protective headpiece 10 in the selected mode. Although it is contemplated that the mask portion will be used most often by itself without the need for the helmet portion. In those events, sports or positions, or where an athlete may desire, which required fuller protection, the helmet portion may be joined to the mask portion. For example, a baseball or softball batter would likely use the mask in the second mode. This selective configuration allows the athlete to switch, if desired, between the first and second modes depending on the athlete, the scenario of the game, the athlete's position or the protection desired. The specifics of the selective configuration process are discussed more fully below.

Turning now to the discussion of the mask portion 12. First, it should be noted that the discussion of the details of the mask portion applies to both configurations or modes. The mask portion 12 has a generally outward curvature so as to generally conform to the athlete's face. The mask portion 12 includes a brow portion 20, temple portions 22 and at least one jaw portion. The brow portion 20 extends across the athlete's brow when the headpiece is in place and substantially shields the athlete's brow area from impact by a projectile. In the illustrated embodiment, which is shown for purposes of illustration and not limitation, the brow portion includes a visor 21 which extends outwards and is adapted to shield the athlete's eyes from the sun or other elements. The temple portions 22 are positioned on at least one and preferably both opposed sides of the brow portion 20 and extend downwardly toward the athlete's jaw to substantially shield the athlete's temple area. In the illustrated embodiment, a jaw portion 24 extends from each of the brow portions and is adapted to substantially shield at least the athlete's lower jaw and potentially the front of the mouth and/or chin.

As illustrated, each jaw portion 24 includes an upper member 40, a lower member 42 and at least one intermediate member 44 which extends between and connects the upper and lower members 40 and 42. In the illustrated embodiment, there are multiple openings 46 defined in the intermediate member 44. The openings are sized to provide some ventilation to the athlete's head and at the same time prevent complete passage of a projectile through the opening. In the illustrated embodiment there are three openings 46 defined in each jaw portion 24 and the openings have a generally rectangular shape. It will be appreciated that the number, shape, size and placement of the openings can be altered and not depart from the spirit and scope of the present disclosure. In alternative embodiments (not shown), the upper and lower members could be sized and positioned such that there are no intermediate member(s) or there could simply be a single upper or lower member.

In the illustrated embodiment, the jaw portions 24, and more specifically the upper and lower members 40 and 42 of each of the jaw portions, connect to one another respectively and form an integral front portion 48. An opening 50 is defined within the front portion and is positioned such that it preferably provides frontal viewing of the mouth of the athlete wearing the protective headpiece. Such a construction allows other players (i.e. the catcher) to see and hear what the athlete (e.g., a pitcher) wearing the headpiece is saying or mouthing. The opening 50 is small enough to prevent complete passage of a projectile therethrough and may be further sized such that the athlete's mouth is substantially unobstructed from frontal viewing. It will be appreciated that it is not necessary that the jaw portions 24 connect to one another but rather other configurations of the jaw portions 24 could be used. For example, the jaw portions 24 may be unconnected and the space defined between them would serve as the opening for ventilation and/or visualization of the mouth.

Together the brow, jaw and temple portions define a substantially open vision aperture 26 sized to provide the athlete with a substantially unobstructed forward and peripheral vision. The vision aperture 26 is generally rectangular and positioned in front of the athlete's eyes when the protective headpiece 10 and more specifically, the mask portion 12, is worn by the athlete. The vision aperture allows the athlete to look peripherally without turning the athlete's head from side to side. For example, when a pitcher is in the stretch position, he or she can see $2^{nd}$ base and home plate without a turn of his or her head. It will be understood that the height "H" of vision aperture 26 could also be sized to prevent the complete passage of a projectile, such as a baseball or softball, through the aperture. Therefore, the height "H" would be different, e.g., larger or smaller, depending on the size of the projectile used in the sport being played by the athlete. In the illustrated embodiment, the vision aperture is not obstructed or otherwise covered by bars or any other structure that is conventionally used in protective helmets; however, it will be understood that one could incorporate those features into the headpiece 10, if desired.

The vision aperture 26 may be surrounded, at least in part, by a reinforcing member 30. The reinforcing member 30 strengthens the mask portion and helps prevent the vision aperture 26 from being enlarged or damaged by a projectile impact. More specifically, the reinforcing member 30 helps limit the brow portion 20 from being further separated from jaw portions 24, for example, in the instance a projectile impacts the mask at the aperture and tries to pass through the vision aperture 26. In addition, the reinforcing member may also be positioned such that it provides a gripping area that can be grasped by the athlete if the athlete would like to carry the protective headpiece 10. For example, the athlete could pass his hand through the vision aperture 26 and grasp around, at least a portion, of the reinforcing member 30 and mask portion 12 in order to carry the protective headpiece 10 when not in use.

Figure 4:
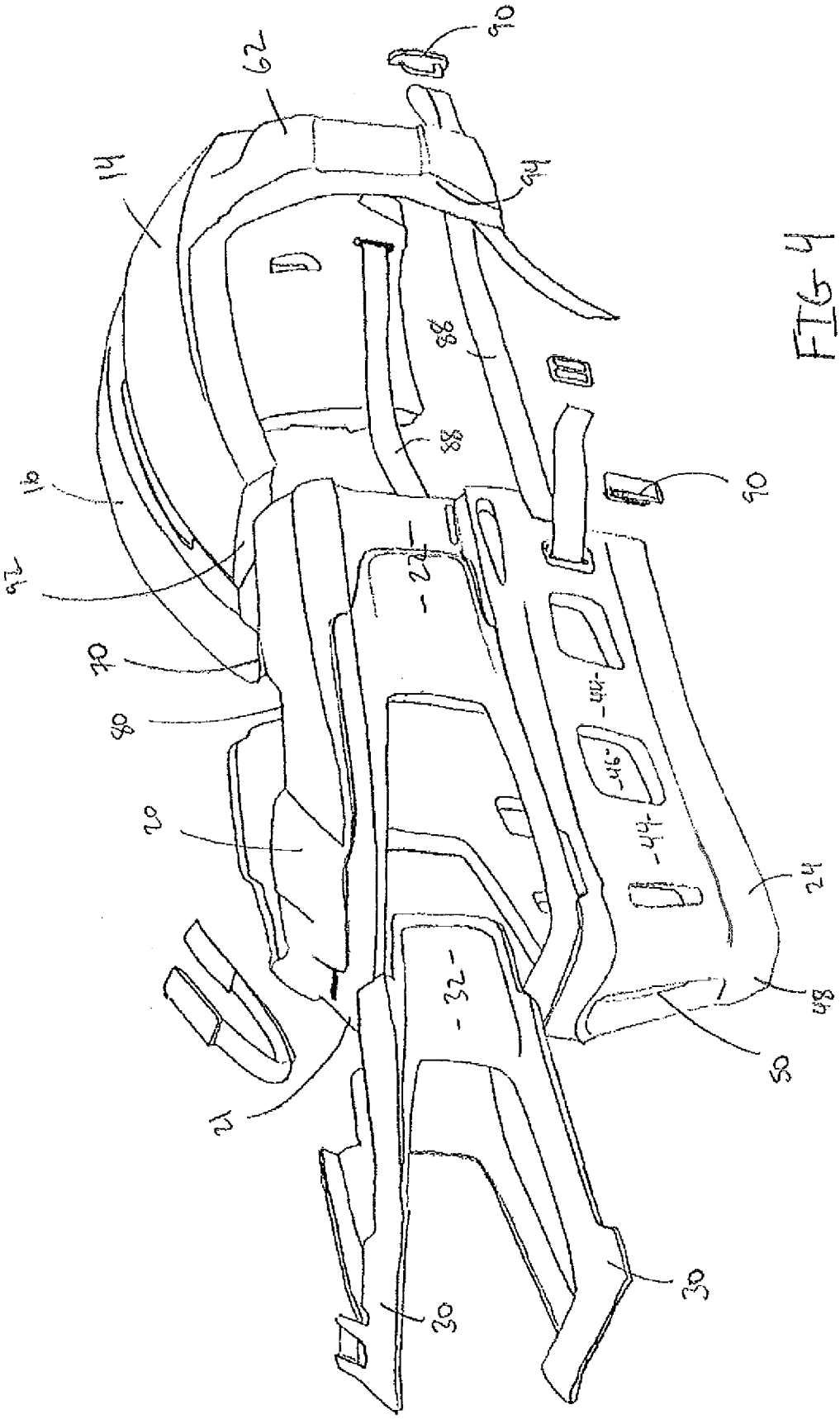
FIG. 4 is an exploded perspective view of the headpiece of FIG. 1.
Figure 5:
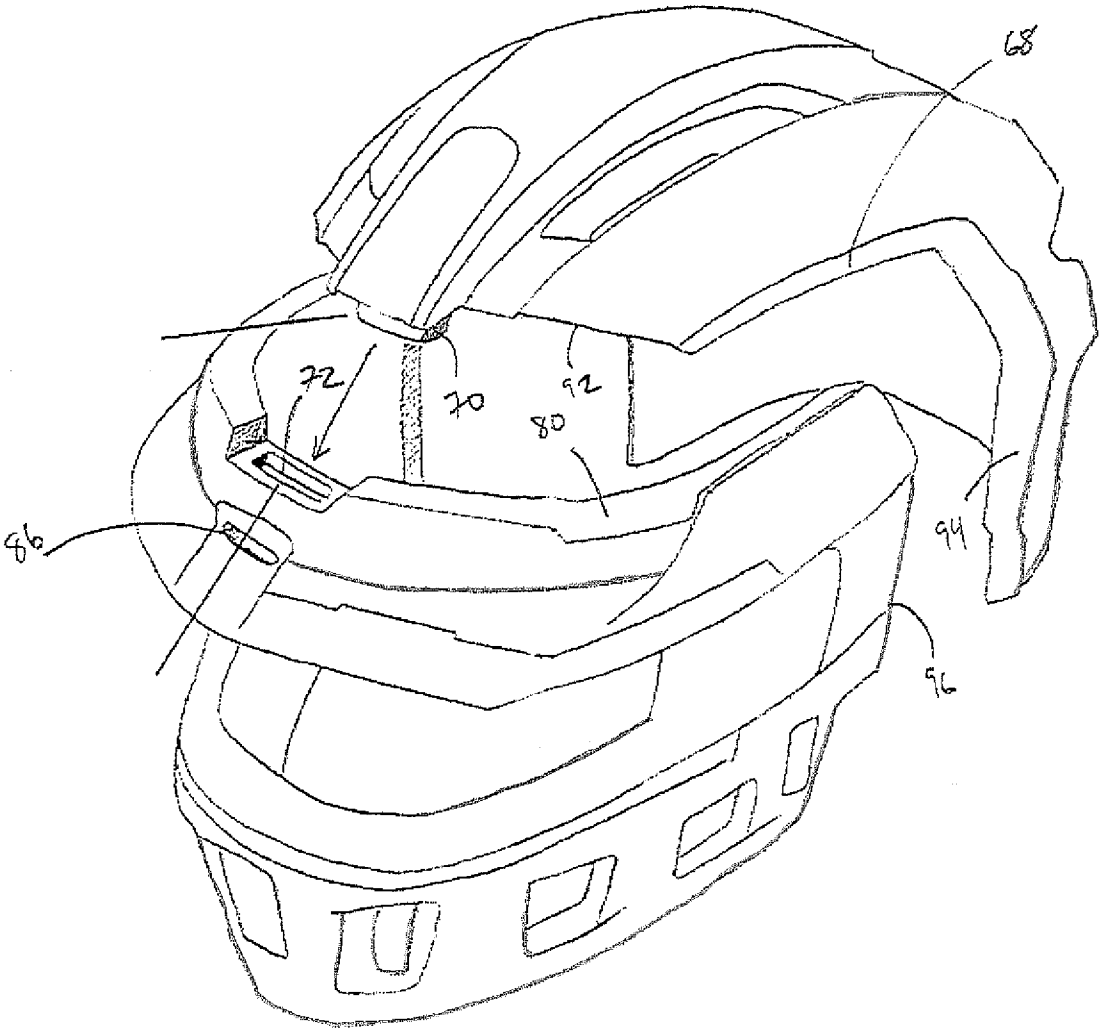
FIG. 5 is a front perspective view of the mask portion separated from the helmet portion of the headpiece of FIG. 1.

As best shown in FIG. 4, the reinforcing member 30 is a substantially rigid member which encircles the entire vision aperture 26. In addition, the reinforcing member 30 includes side extensions or wings 32 that extend over at least a portion of each temple portion 22 for increased protection. While in the illustrated embodiment the reinforcing member 30 is positioned over the other mask portions, it will be appreciated that the reinforcing member 30 could be partially or completely embedded within the other portions of the mask portion 12. In addition, reinforcing members could be embedded within other portions of the mask (e.g., the lower member 40 of the jaw portion) in order to further strengthen or support the mask portion 12. The reinforcing member 30 may be constructed of any durable, rigid material such as plastic. In the illustrated embodiment, the reinforcing member is constructed of a molded polycarbonate; however, it will be appreciated that other materials may be used and not depart from the spirit or scope of the present disclosure.

Turning now to the discussion of the helmet portion 14. The helmet portion 14 has a generally outward curvature so as to generally conform to the athlete's head. In the illustrated embodiment, the helmet portion 14 includes a crown portion or member 60 and a rear portion or member 62. The crown portion or member 60 substantially shields the crown or top of the athlete's head from impact by a projectile when the protective headpiece 10 is worn by the athlete. The rear portion or member 62 substantially shields the rear of the athlete's head from impact by a projectile when the protective headpiece 10 is worn by the athlete. It will be appreciated that, depending on the protection desired, the helmet portion in other embodiments may only include the crown member or rear member or the degree of protection bay differ in different helmet portions or within helmet portions.

In the illustrated embodiment, the helmet portion 14 defines multiple openings 64 which are sized and positioned to provide some ventilation to the athlete's head. The openings are sized to provide sufficient ventilation and at the same time prevent passage of a projectile. In the illustrated embodiment there are a plurality of openings defined in the helmet portion 14, a plurality (four) of openings in the crown member 60 and a plurality (five) openings in the rear member 62. In addition, there are two elongated openings 66, one on either side of the headpiece 10, which are defined by the combination of a side wall 68 of the helmet portion 14 and the top wall 80 of the mask portion 12. It will be appreciated that the number, size and placement of the openings can be altered and not depart from the spirit and scope of the present disclosure.

In addition, in the illustrated embodiment, there is an optional notch 70 defined in the rear member 62 of the helmet portion which provides generally unobstructed access therethrough. The notch affords increase ventilation, and also may be sized and configured to enable the hair of an athlete wearing the protective headpiece to be gathered together in the nature of a braid or ponytail and positioned within the notch 70. If employed, the notch is preferably large enough to allow ease of positioning of the athlete's hair within the notch but small enough to prevent the projectile from passing completely therethrough. In an alternative embodiment (not shown), the notch could be substituted with an enclosure which completely entrains the athlete's hair which may be pushed or pulled through the enclosure. More specifics of the notch or enclosure can be found in U.S. Pat. Nos. 5,535,454 and 5,666,670 of which the entireties of their disclosures are hereby incorporated by reference. It will be appreciated that one could completely omit the notch or aperture from the protective headpiece and not depart from the spirit or scope of the present disclosure.

As mentioned previously, the protective headpiece can be worn in two different modes. When the headpiece 10 is in the first mode, the athlete is only wearing the mask portion 12 and when the headpiece 10 is in the second mode, the athlete is wearing the mask portion 12 and helmet portion 14.

A retainer is secured to the mask portion 12 and is configured to removably retain the mask potion on the athlete's head. In the first mode, the retainer may be a web of adjustable straps (including elastic straps) or other securement structure which holds the mask portion 12 in place on the athlete's face. In the embodiment illustrated in FIGS. 7 and 8, the retainer includes three adjustable straps. The retainer may also include a back plate 82 of any selected configuration. Of course, the particular strap arrangement can vary. As shown, top strap 84 passes over the top of the athlete's head and has a first end which passes through a slot 86 defined in the brow portion 22 of the mask portion 12 and a second end connected to the back plate 82. The first end is then looped back and connected to a surface of the top strap 84. More specifically, the first end includes either loops or hooks which cooperate with the other of the loops or hooks which are positioned on the surface of the top strap. It will be appreciated that strap may be held in place using other locking means. A side strap 88 is secured to each side of the mask portion 12 and more specifically to each jaw portion 24 of the mask portion 12. In the illustrated embodiment, the side straps 88 each include an anchor 90 which fixes the strap to the mask portion 12. The side straps 88 are then connected to the back plate 82. It will be appreciated that additional straps may be used to hold the mask portion in place.

The optional back plate 82 is sized and configured to help hold the mask portion on the athlete's head. In the illustrated embodiment, the back plate has a generally arcuate configuration may include a notch 70*a* which can accommodate the athlete's hair as discussed above with respect to the helmet portion 14. It will be appreciated that other shapes and configurations may be used.

When the protective helmet 10 is in the second mode (see FIGS. 1-6), the mask portion 12 and helmet portion 14 mate and/or connect to one another. In this second mode, the helmet portion 14 acts as the retainer to hold the mask in place. In the illustrated embodiment, the helmet portion 14 is connected to the mask portion using multiple structures. For example, the helmet portion 14 includes a projection 70 which extends from a front surface 92 of the crown member 60. This projection fits within aperture 72 which is defined in the top surface 80 of the mask portion 14 (see FIGS. 5 and 6). The projection 72 and aperture 70 cooperate to connect the mask and helmet portions to one another and preferably provide an interference fit. While the illustrated embodiment only discloses one projection and aperture, it will be appreciated that additional projections/apertures or other connecting structures may be included at different points along the interface between the mask and helmet portions. Alternatively, the projection and aperture could be on the opposite surfaces than shown. That is, the projection can be on the mask portion and the aperture on the helmet portion.

In addition, the top surface 80 of the mask portion 12 and front surface 92 of the helmet portion 14 and the rear surface 96 of the mask portion 12 and back surface 94 of the helmet portion 14 may be complimentary or cooperatively shaped in order to allow mating of the two portions. In the illustrated embodiment, the surfaces are angled; however, it will be appreciated that other configurations may be used, for example, a stepped configuration.

Figure 6:
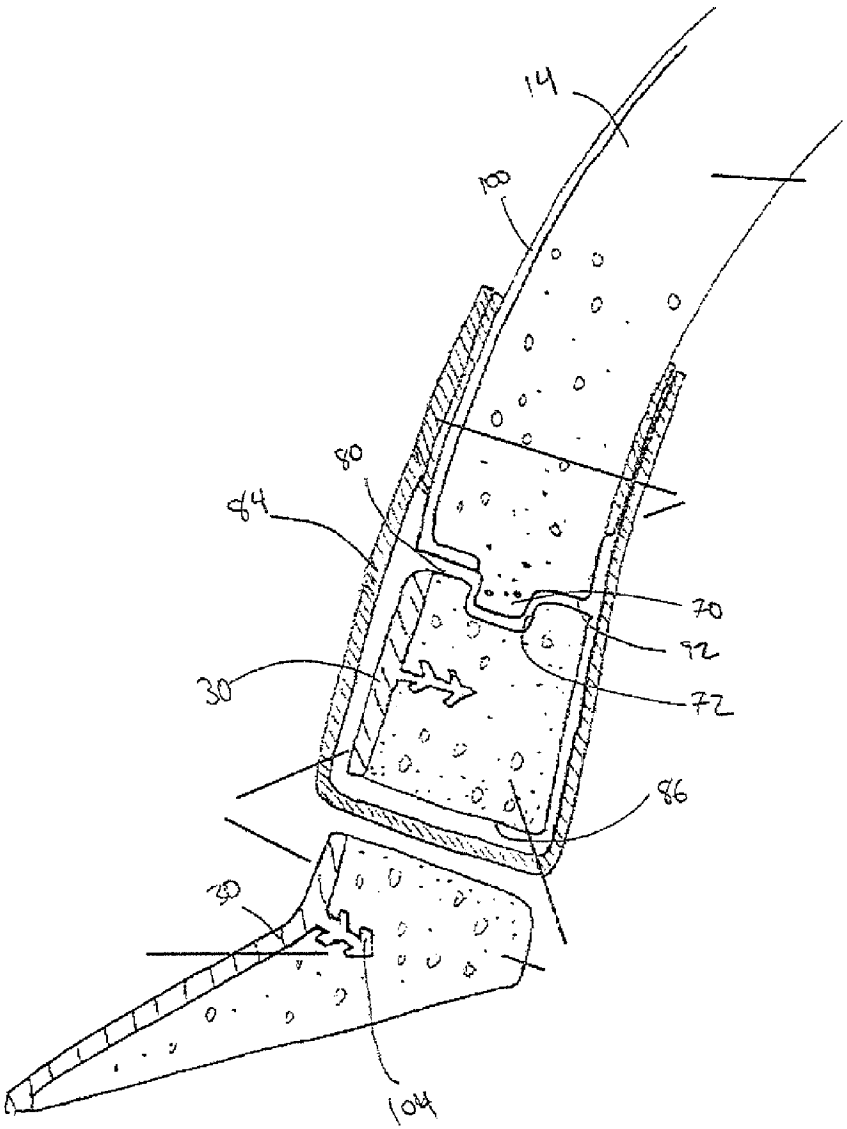
FIG. 6 is a cross-sectional view of a portion of the headpiece of FIG. 1.

Further, straps or other securement structures hold the mask and helmet portions together and therefore secure the protective headpiece on the athlete's head. As best illustrated in FIGS. 1 and 6, the illustrated embodiment includes a top strap 84 (which may be elastic) with a first end that is secured on an inside surface of the helmet portion and more specifically, the crown member 62, and a second end which is fed through the aperture 86 in the brow portion 20 of the mask portion 12 and removably secured to an outside surface of the helmet portion 14. In the illustrated embodiment the top strap 84 is removably secured to the helmet portion using complimentary hooks and loops; however, it will be appreciated that other securement structures may be used. In addition, as best shown in FIG. 4, side straps 88 (which may be elastic) are connected to the mask portion 12 and helmet portion 14 using anchors 90.

It will be appreciated that other features could be incorporated into the protective headpiece which are not illustrated. For example, padding such as sealed-edge open-cell soft foam may be positioned at different spots on the inner surfaces of the mask and helmet portions. The padding can be sized and configured to properly fit the protective headpiece on the athlete's head and minimize movement. In addition, a moisture wicking material such as COOLMAX® fabric of Invista can be incorporated on the inner surfaces of the headpiece or on top of the padding in order to provide the athlete some relief from sweating. In order to accommodate an athlete wearing glasses, such as sunglasses or eyeglasses, each of the temple portions may includes an aperture (not shown) for receiving at least a portion of the glasses. These apertures allow the athlete wearing the protective headpiece of the present disclosure to wear glasses, something many conventional helmets do not accommodate.

The specific strength, thickness, materials and other parameters for construction of the protective headpiece may be varied according to the particular sport or to any particular safety standards for the sport with which the headpiece will be used. For example, in baseball and softball, the National Operating Committee on Standards in Athletic Equipment (NOCSAE) has developed proposed minimum requirements to be met by a protective headpiece. Such standards may dictate the size of the headpiece with regard to that amount of surface area of the player's head, and the specific portions thereof, which must be protected in order to pass certification under the test standards.

The protective headpieces illustrated in the figures here, are the configuration preferred for baseball or softball; however, it will be understood that variations thereof will occur due to different levels and age participation in the sport. The mask and helmet portions are preferably very light weight and formed, at least in part, of an impact absorbing material which can withstand the impact of at least one projectile such as a baseball. In one embodiment the material is a single-impact or sacrificial material adapted to be discarded after a single projectile impact. In other embodiments, the headpiece may be of a material that can absorb repeated impact, such as carbon fiber or other composite materials. In the illustrated embodiment, the impact absorbing material is foamed polymer such as polystyrene and more specifically an expanded polystyrene ("EPS") foam. This material is particularly suitable for making the mask and helmet portions because of its energy absorption characteristics combined with its light weight; however, it will be appreciated that other materials could be used and not depart from the spirit and scope of the invention. EPS foam mask and helmet portions results in a lightweight protective headpiece which is significantly lighter than conventional headpieces constructed of rigid plastic and metal.

The preferable EPS is a medium density foam, such as a density of approximately 5 lbs per cubic foot. However, it will be understood that the density could easily be increased or decreased to achieve different strengths as needed. The preferred thicknesses of the EPS foam is in areas that are to be tested for impact (e.g. the mask portion) is about 0.6 to 0.9 inches, preferably about 0.7 to 0.8 inches and more preferably about 0.75 inches. It should be noted that the thicknesses can vary, such as plus or minus 0.1 inches, due to the surface configurations of the headpiece. In addition, one could make the top of the helmet portion 14 thinner since it is not typically exposed to projectile impact and is not tested under certain NOCSAE standards.

It will be appreciated that the mask and cranium portions may be constructed of different materials or a combination of materials. For example, as best illustrated in FIG. 6, the headpiece may include an outer shell 100 which protects the headpiece 10 from minor scrapes and scratches and also provides a substantially water repellant coating. In the illustrated embodiment, the shell 100 is constructed of vacuum formed plastic and more specifically polycarbonate with a preferred thickness of approximately 0.07 inches. However, it will be appreciated that other materials and thicknesses may be used for the shell. The shell may add protection against impact resistance or be sufficiently thin to have only or primarily ornamental benefit. Additionally, as discussed more fully below, it will be appreciated that the protective headpiece could also be constructed of an impact resistant material such as a rigid plastic and more specifically a carbon fiber or other composite materials.

In addition, as mentioned above, the mask portion may also include a rigid reinforcing member 30 that surrounds the vision aperture 26. This reinforcing member may be constructed of plastic or more specifically polycarbonate, such as with a thickness of approximately 0.08 inches. Again, it will be appreciated that other materials and thicknesses may be used for the reinforcing member.

In order to manufacture the mask portion 12 of the illustrated embodiments, the reinforcing member 30 is preferably first injection molded to include anchors or barbs 104 (see FIG. 6). The reinforcing member is then placed into a mold to allow the EPS foam to be mold therearound and attach thereto. The anchors 104 help grasp on or otherwise connect the EPS foam to the reinforcing member. If desired, an outer decorative and/or protective shell of plastic may be bonded to or vacuum formed over a portion of the exposed EPS. With respect to the helmet portion 14, the helmet portion is formed with the EPS and then if desired, a shell of plastic may be bonded to or vacuum formed over a portion of the exposed EPS. It will be appreciated, that other methods of manufacturing may be incorporated.

Figure 7:
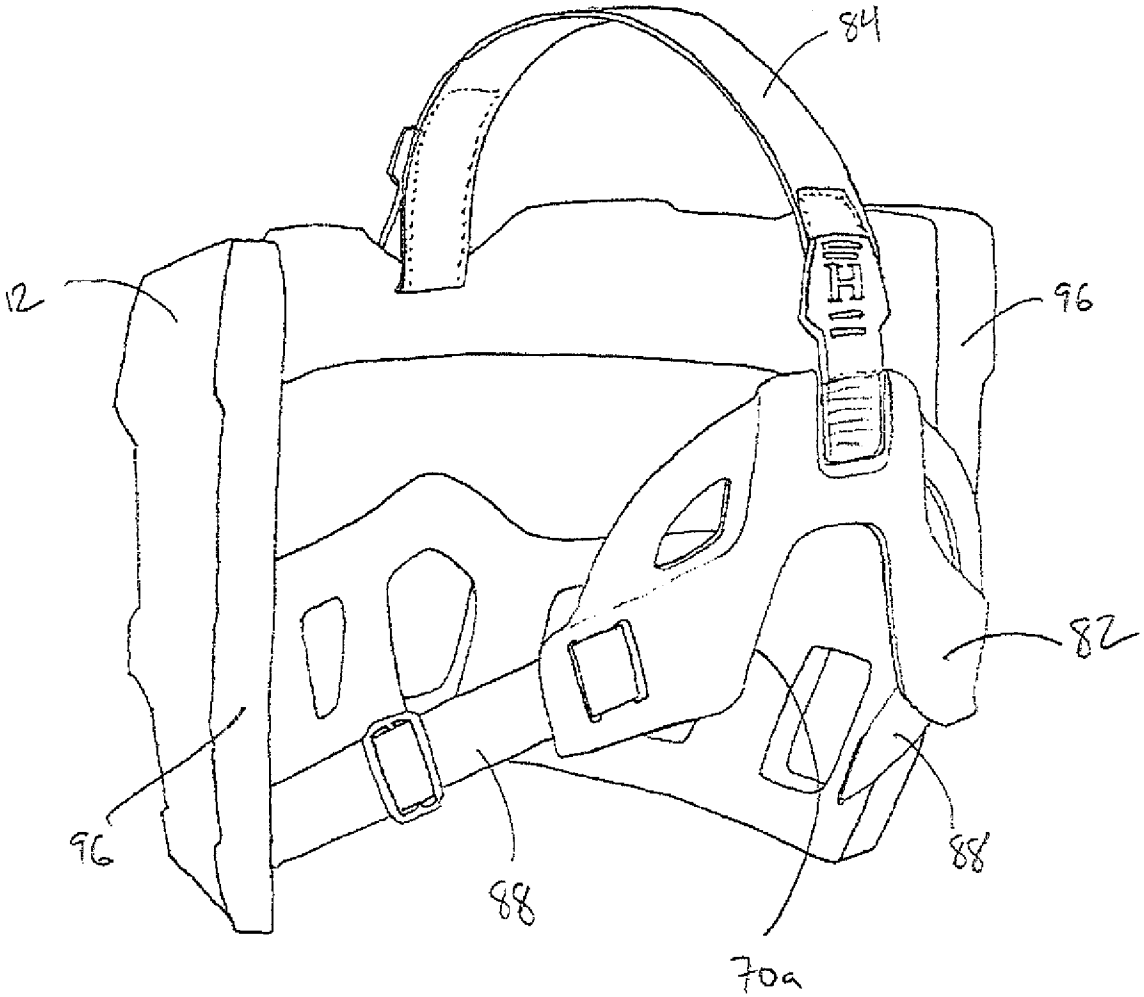
FIG. 7 is a rear perspective of another embodiment of a protective headpiece in accordance with the present disclosure.
Figure 8:
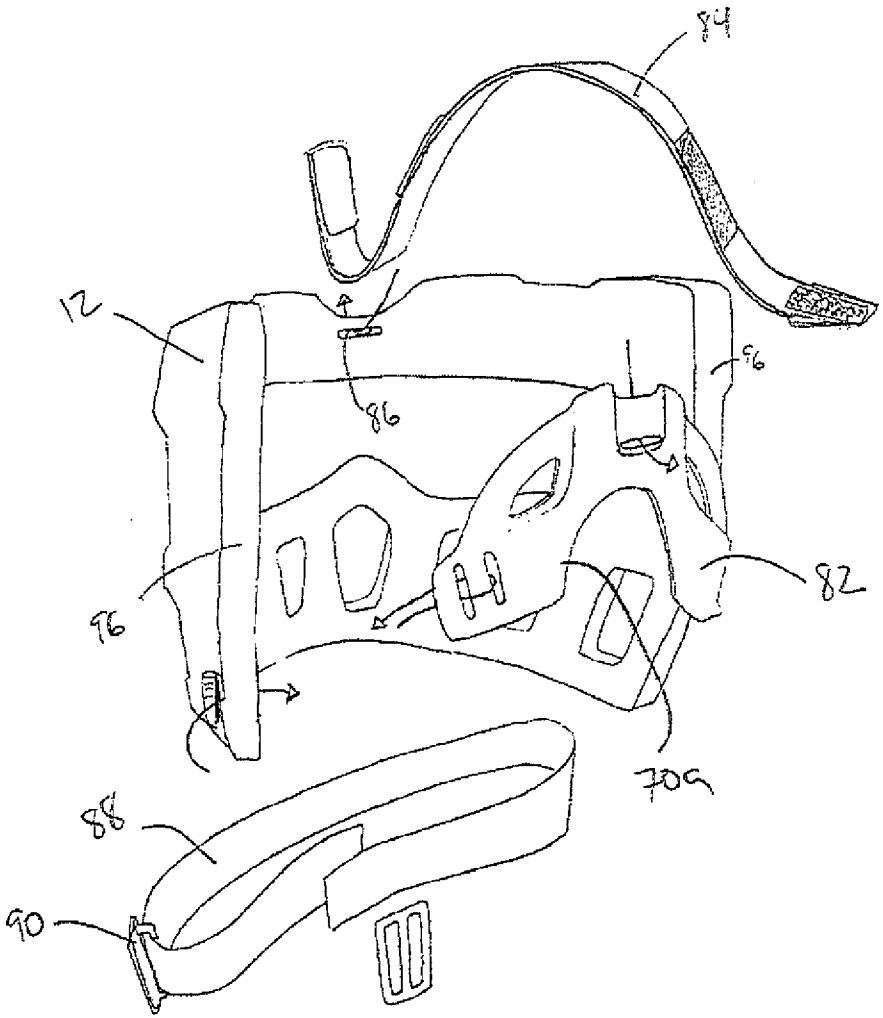
FIG. 8 is an exploded perspective view of the headpiece of FIG. 7.
Figure 9:
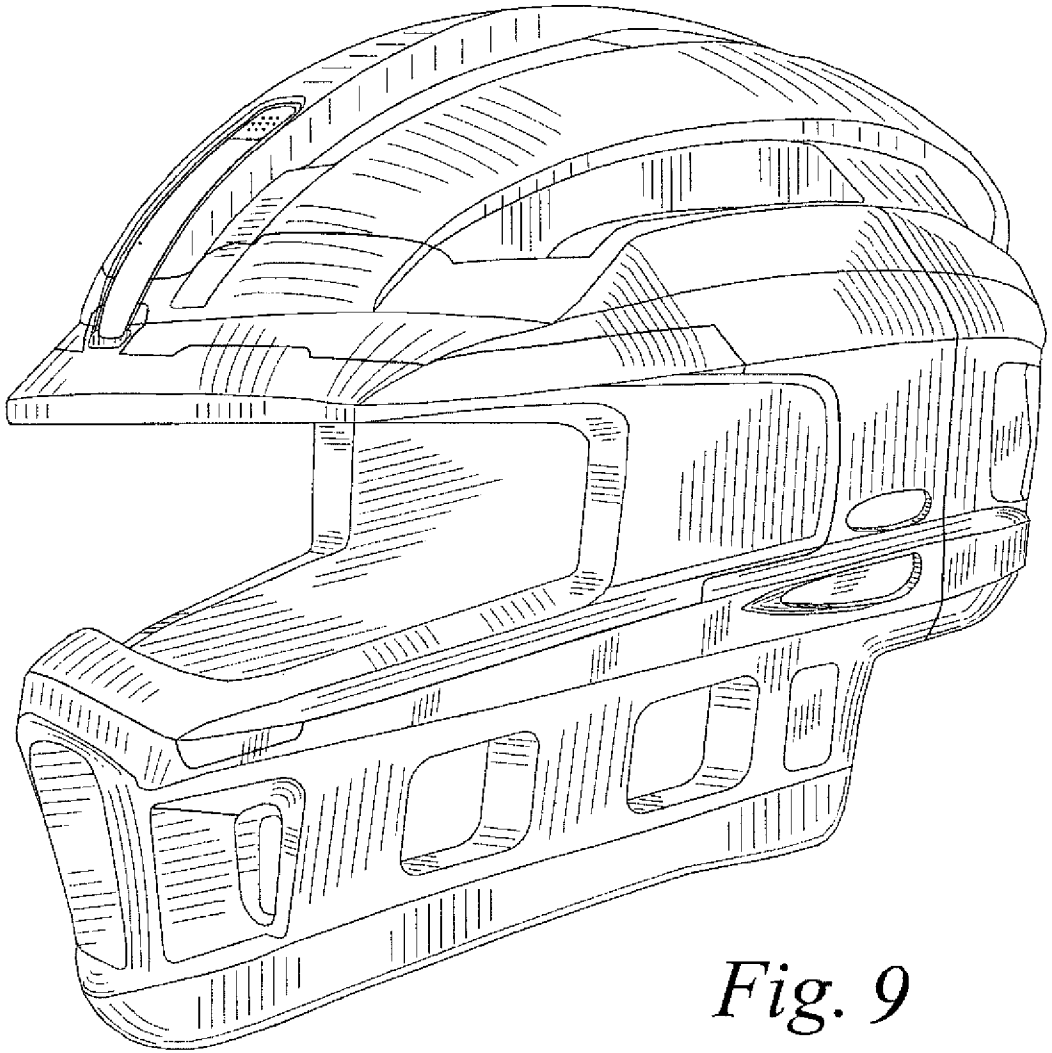
FIGS. 9-15 are a variety of views of yet another embodiment of a protective headpiece in accordance with the present disclosure.
Figure 10:
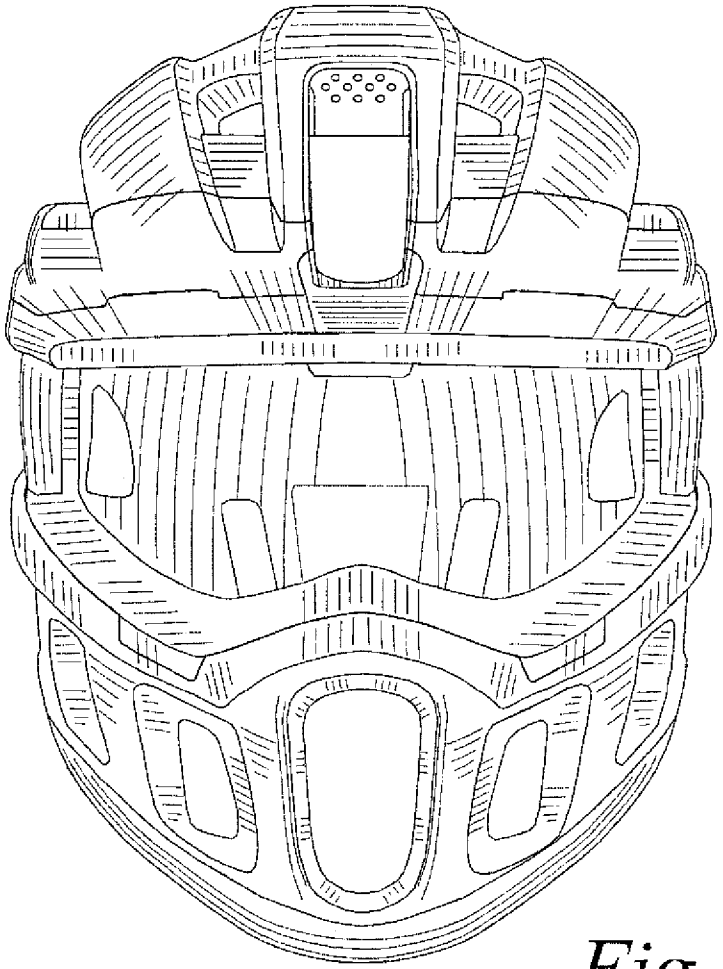
Figure 11:
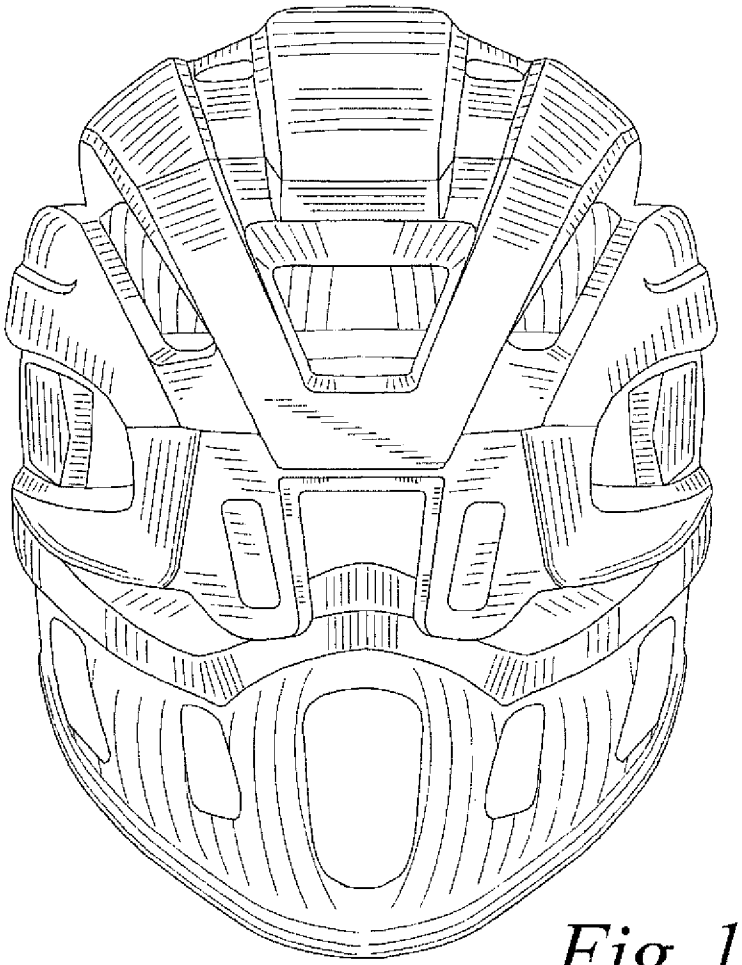
Figure 12:
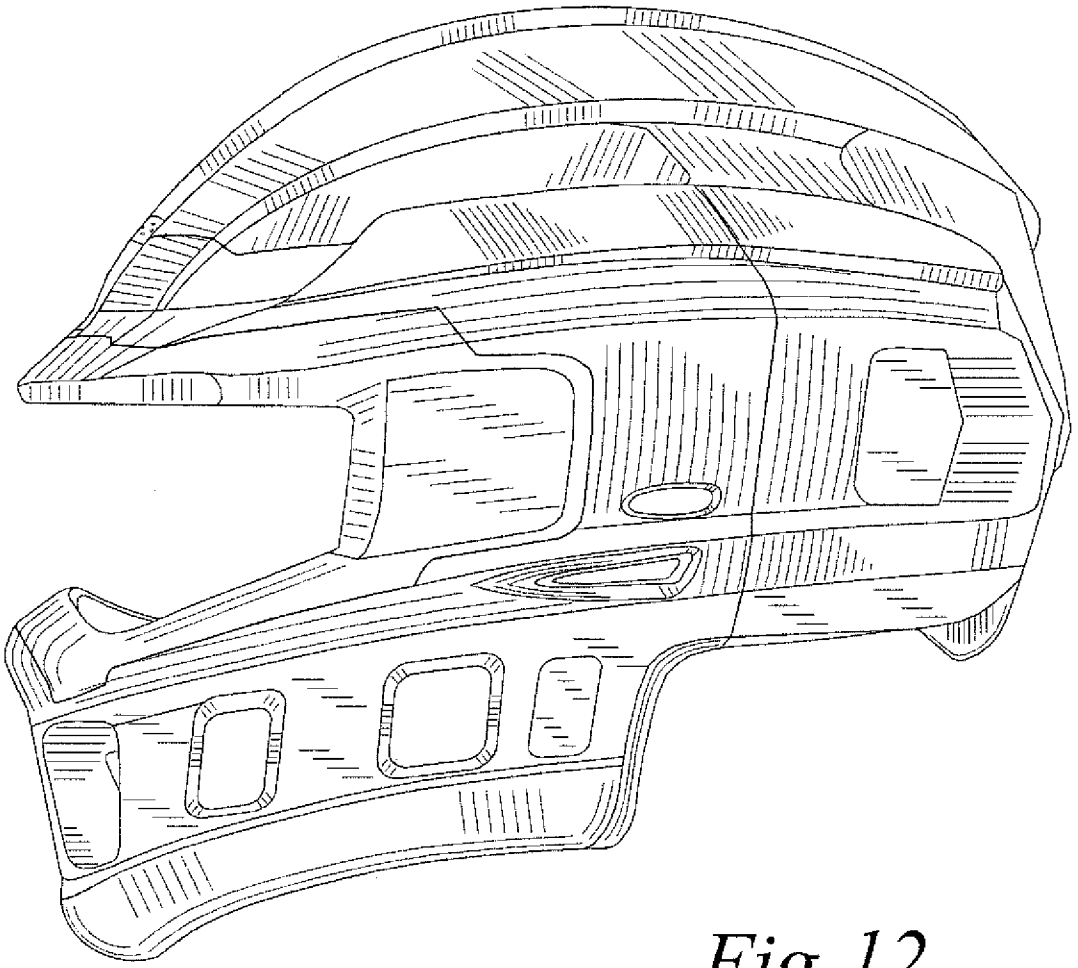
Figure 13:
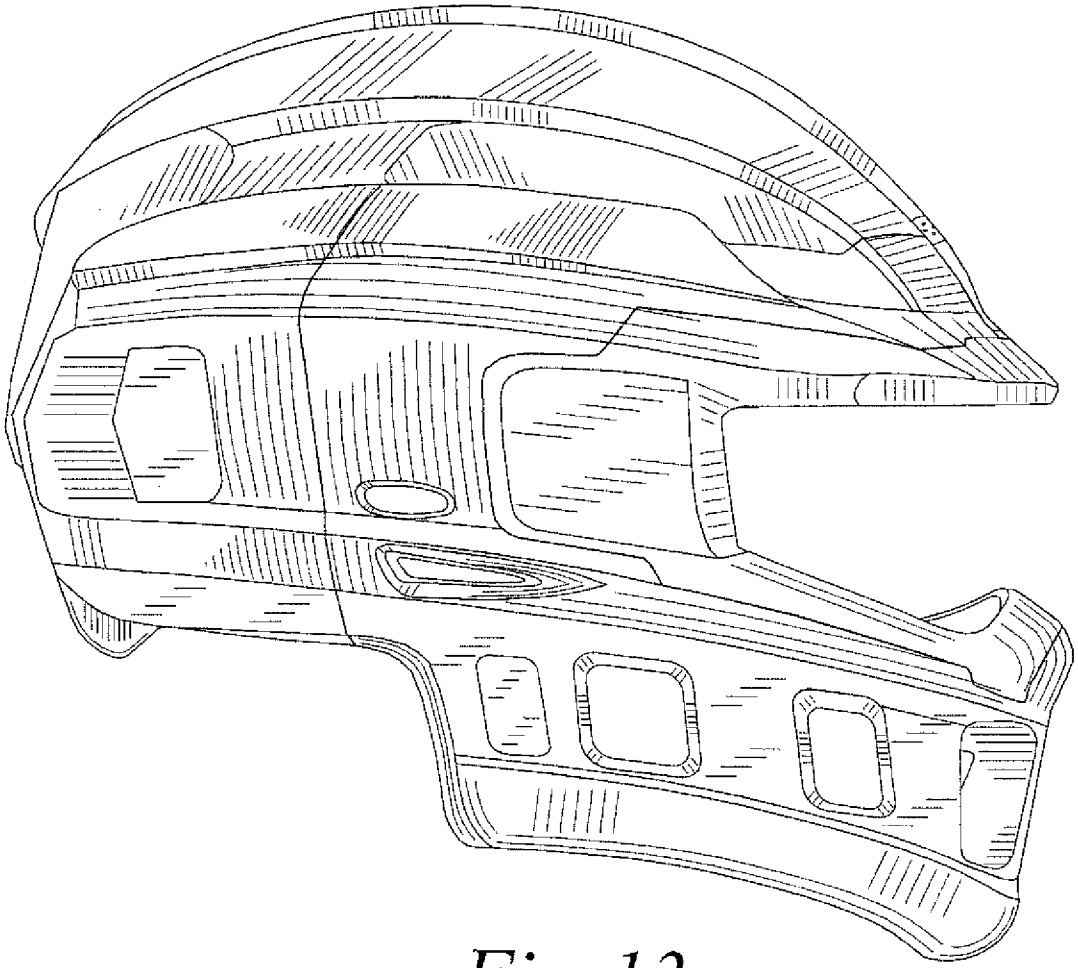
Figure 14:
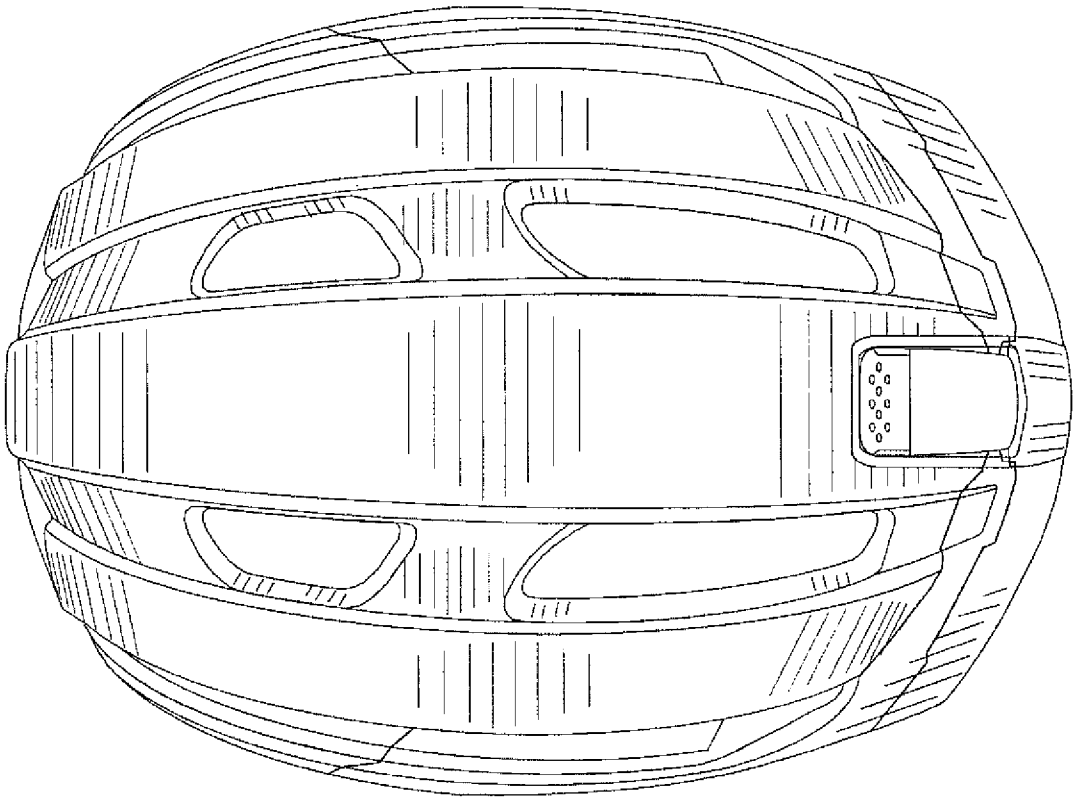
Figure 15:
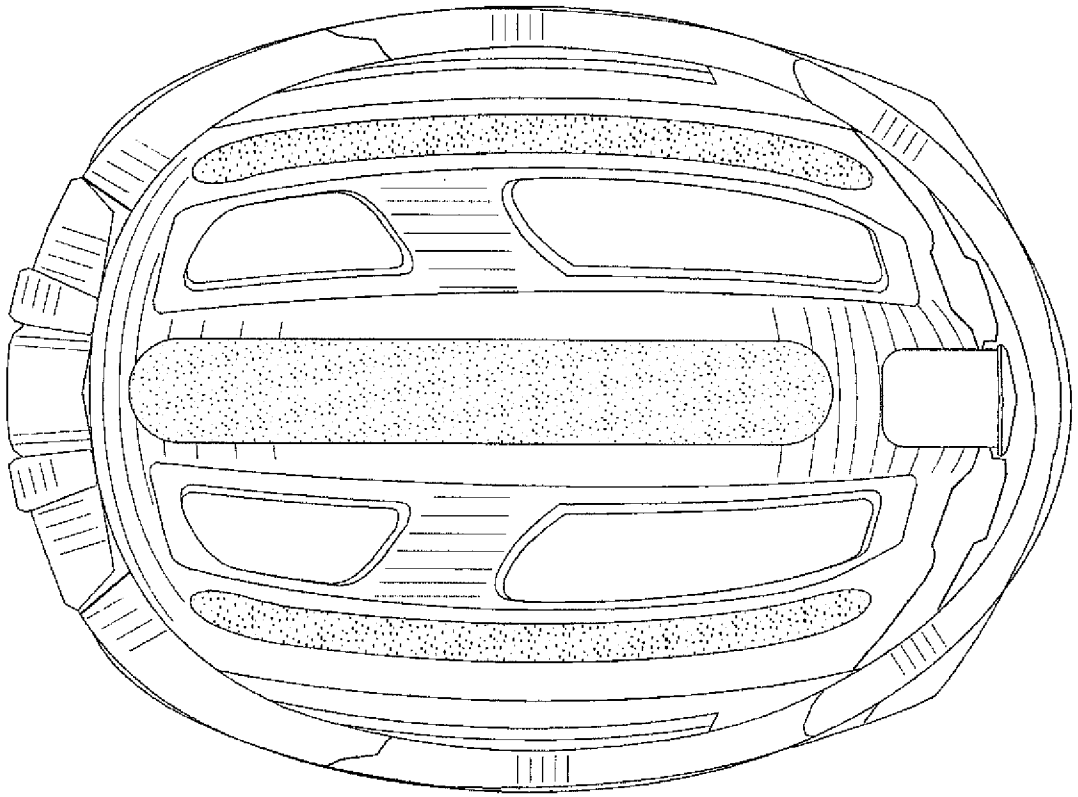

In use, the helmet and mask portions may be used by the athlete in the first or second modes described above. In the first mode, the athlete will affix the straps to the back plate 62 and adjust their lengths in order to comfortably fit the mask portion and back plate to the athlete's head. More specifically, the top strap 84 will be passed through aperture 86 in the mask portion 12 and affixed thereto. The athlete will also connect the side straps 88 to the mask portion 12 and back pate 62. When completed, the headpiece will be in the first mode with face-only protection (including adjacent areas, such as the temple) as depicted in FIG. 7.

If the athlete would like or rules require that the entire head to be protected (e.g. baseball batter), the athlete can simply configure the protective headpiece into the second mode. In order to do so, the athlete will disconnect the side and top straps from the back plate 82 and attach the straps to the helmet portion 14. Alternatively, a new set of straps may be used such that the other straps can stay affixed to the back plate 62 when removed. The projection 70 of the helmet portion 14 will be positioned within the aperture 72 of the mask portion in order to connect the two portions to one another. The top and side straps can be adjusted in order to comfortably fit the protective headpiece to the athlete's head. When completed, the headpiece will be in the second mode with face and head protection as depicted in FIGS. 1-6.

As mentioned above, the protective headpiece could also be constructed of an impact resistant material such as a rigid plastic and more specifically a carbon fiber, such as polycarbonate, or Acrylonitrile Butadiene Styrene (ABS). In such a construction, either one or both of the mask portion 12 and helmet portion 14 as described herein and shown in the figures may be constructed either entirely or partly of a rigid impact resistant material. For example, the entire portion could be constructed out of the impact resistant material. Alternatively, the impact resistant material could be layered on top of, between or below other materials such as an impact absorbing material described above. Further, the impact resistant material could be used only in the portions of the helmet where there is likely a projectile impact (e.g. the brow and temple portions).

When impact resistant material is used, the mask portion 12 and/or helmet portion 14 are preferably formed as a unitary piece using known processes such as molding or casting, however, alternative methods of construction will be understood by ones skilled in the art. The thicknesses of the impact resistant material may be selected in order to provide the desired strength and resistance. For example, the preferred thicknesses of the ABS when used in areas that are to be tested for impact (e.g. the mask portion and more specifically the temple portions) is about 2 to 5 millimeters and preferably about 3 to 4 millimeters. However, it will be understood that the thickness could easily be increased or decreased to achieve different strengths as desired. It will also be appreciated that if the mask portion 12 is formed out of a rigid impact resistant material the reinforcing member 30 may be omitted.

Figure 16:
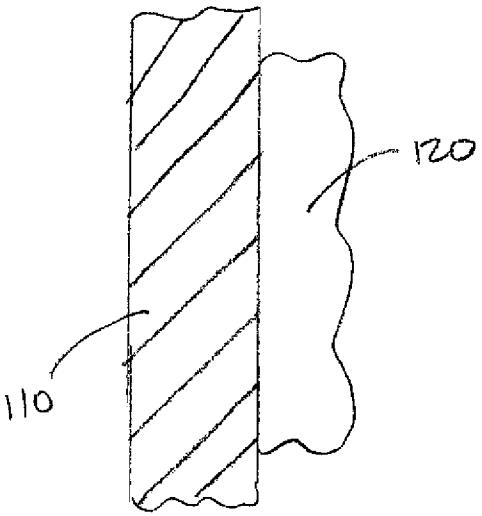
FIG. 16 is a fragmentary cross-sectional view of a portion of a protective headpiece according to another embodiment.

A protective headpiece constructed out a rigid impact resistant material may also include padding to provide a snug, comfortable fit to the athlete's head as is known in the art. As illustrated in FIG. 16, the protective helmet may have a shell 110 constructed of a single layer of impact resistant material with a padding or foam 120 attached and positioned at different spots on the inner surfaces of the mask and helmet portions (e.g. the temples, crown, forehead and/or chin). In one embodiment, the foam is a sealed-edge open-cell soft foam. The padding can be sized, configured and positioned to properly fit the protective headpiece on the athlete's head and minimize movement. In addition, a moisture wicking material such as COOLMAX® fabric of Invista can be incorporated on the inner surfaces of the headpiece or on top of the padding in order to provide the athlete some relief from sweating.

Figure 18:
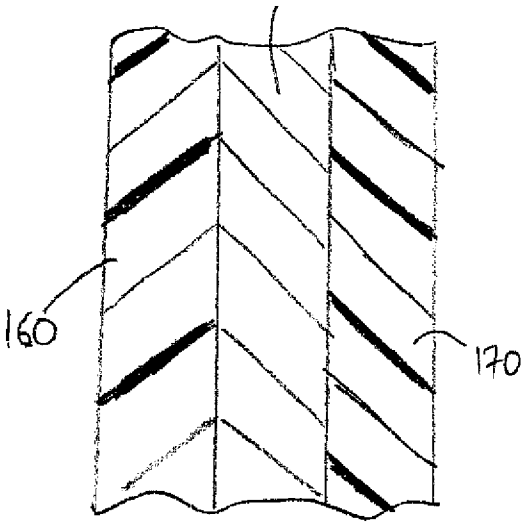
FIG. 18 is a fragmentary cross-sectional view of a portion of a protective headpiece according to still yet another embodiment.
Figure 17:
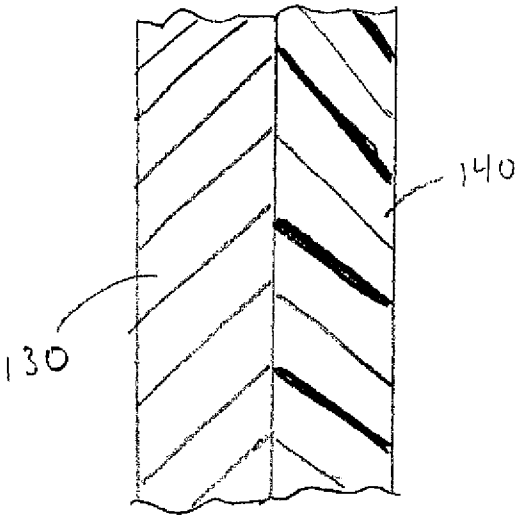
FIG. 17 is a fragmentary cross-sectional view of a portion of a protective headpiece according to yet another embodiment.

In an alternative embodiment illustrated in FIG. 17, the impact resistant material may be formed as a separate layer over, at least part, of an impact absorbing layer. For example, the helmet portion 14 may include an outer shell 130 constructed of an impact resistant material and an inner core 140 constructed of an impact absorbing material. Preferably, the thickness of the inner core is substantially uniform over the entire inner core. In one embodiment the outer shell is constructed of ABS and the inner core is constructed of EPS foam. The inner core may be affixed to the outer shell using any method known in the art, such as adhesive or fasteners. It will be appreciated that the materials could be swapped such that the outer shell 130 is constructed of an impact absorbing material and the inner core 140 is constructed of an impact resistant material. As mentioned above, if desired, padding or foam may be attached and positioned at different spots on the inner surfaces of the mask and helmet portions (e.g. the temples, crown, forehead and/or chin) in order to help retain the headpiece on the athlete's head. It will be understood that additional layers could be added and not depart from the spirit and scope of the present disclosure. For example, an interior layer 150 of impact resistant material could be sandwiched between interior and exterior layers 160 and 170 of impact absorbing materials (see FIG. 18). However, the number of layers, the materials used and the positioning of such layers could be altered and not depart from the spirit and scope of the present disclosure.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

What is claimed is:

1. A protective headpiece for an athlete of a game using a projectile to protect at least a portion of the brow, temple and jaw of the athlete's head against impacts by the projectile, the protective head piece being releasably securable onto the athlete's head and comprising:

a mask portion comprising at least one of an impact absorbing material and an impact resistant material and including:

a front brow portion configured to substantially shield the athlete's brow area and having opposed sides;

a side temple portion extending from each side of the brow portion and configured to substantially shield a temple area;

the front brow and side temple portions having an upper terminal edge extending in a direction along the front brow portion and along each of the side temple portions and defining an unshielded crown opening extending from the front brow portion rearwardly between the side temple portions and an unshielded rear opening;

a jaw portion extending from each of the side temple portions and configured to substantially shield one side of the athlete's lower jaw;

the jaw portions being connected to define a front portion which includes an opening sized to permit frontal viewing of the athlete's mouth;

together the front brow, jaw and side temple portions defining a substantially open vision aperture defined by an edge surrounding the entire vision aperture and sized to provide the athlete with a substantially unobstructed forward and peripheral vision;

a separate substantially rigid reinforcement member secured to the mask portion having a perimeter edge designed to surround the entire vision aperture, the reinforcement member including a side extension extending from each side of the vision aperture to a position rearwardly of the vision aperture and over at least a part of each side temple portion wherein the perimeter edge is designed to encompass and reinforce the entire edge of the vision aperture; and a retainer secured to the mask portion and configured to removably retain the mask portion on the athlete's head.

2. The headpiece of claim 1 wherein the impact resistant material comprises Acrylonitrile Butadiene Styrene.

3. The headpiece of claim 1 of sufficient thickness to resist the impact and reduce injury potential from a baseball.

4. The headpiece of claim 1 wherein the retainer comprises a helmet portion releasably secured to the mask portion, the helmet portion including (a) a curved forward projecting crown portion extending between the front brow portion and the rear opening and between the side temple portions covering the crown opening of the mask portion and substantially shielding the crown of the athlete's head and (b) a curved rear portion depending from the crown portion and covering the rear opening of the mask and substantially shielding the back of the athlete's head against projectile impact.

5. The headpiece of claim 4 in which one of the mask and helmet portions includes an edge aperture and the other of the portions includes an edge projection received within the aperture when the helmet portion is releasably secured to the mask portion.

6. The headpiece of claim 4 wherein the helmet portion comprises at least one of an impact absorbing material and an impact resistant material.

7. The headpiece of claim 6 wherein the helmet portion comprises an impact resistant material and an impact absorbing material interior of the impact resistant material.

8. The headpiece of claim 1 wherein the front brow portion includes a projecting front rim forming a visor extending therefrom sufficiently to shield the athlete's eyes from the sun.

9. The headpiece of claim 1 wherein the mask portion comprises an impact resistant material and an impact absorbing material interior of the impact resistant material.

10. The headpiece of claim 1 comprising a plastic outer layer and a foam inner layer, the plastic outer layer including integral foam retaining anchors extending into and connecting the foam layer and the plastic layer.

11. The headpiece of claim 1 in which each jaw portion includes (a) spaced-apart upper and lower members, the upper member extending between the respective temple portion and front portion and (b) an intermediate member extending between and connecting the upper and lower members, the intermediate member including a ventilation opening therein.

12. The headpiece of claim 1 on which the reinforcing member encircles the open vision aperture allowing the vision aperture to remain fully open for forward and peripheral viewing free of vision-impairing structures.

13. The headpiece of claim 1 in which the reinforcing member is positioned in a relief area around the open vision aperture.

14. A modular protective headpiece for an athlete of a game using a projectile to protect the athlete's head against impacts by the projectile, the modular protective head piece comprising:

a mask having portions configured to substantially shield the athlete's brow, temple and lower jaw and defining a vision aperture defined by an edge surrounding the entire vision aperture and that is entirely surrounded by a separate substantially rigid reinforcing member secured to the mask having a perimeter edge designed to surround the entire vision aperture and including a side extension extending from each side of the vision aperture to a position rearwardly of the vision aperture and over at least a part of each temple, the top of the mask portion being substantially open from the brow rearwardly and between the temples, wherein the perimeter edge is designed to encompass and reinforce the entire edge of the vision aperture;

a separate helmet removably attachable to the mask and including an elongated curved crown portion extending rearwardly from a front edge adjoining the brow portion of the mask to protect the crown of the athlete's head and a curved rear portion extending downwardly from the crown portion to protect the rear of the athlete's head when the helmet is attached to the mask, the mask and helmet having complimentarily shaped edge surfaces to facilitate mating attachment.

15. The headpiece of claim 14 wherein the mask comprises at least one of an impact absorbing material and an impact resistant material.

16. The headpiece of claim 14 wherein the helmet comprises at least one of an impact absorbing material and an impact resistant material.

17. The headpiece of claim 14 wherein a retainer is secured to the mask and configured to removably retain the mask on the athlete's head, and the mask includes a retainer-receiving aperture.

18. The headpiece of claim 14 wherein one of the mask and helmet includes an edge aperture and the other includes an edge projection receivable in the aperture to provide an interference fit between the helmet and mask when they are removably attached.

19. A protective headpiece for an athlete of a game using a projectile to protect at least a portion of the brow, temple and jaw of the athlete's head against impacts by the projectile, the protective head piece being releasably securable onto the athlete's head and comprising:

a mask portion comprising at least one of an impact resistant material and an impact absorbing material and including:

a front brow portion configured to substantially shield the athlete's brow area and having opposed sides;

a side temple portion extending from each side of the brow portion and configured to substantially shield a temple area;

the front brow and side temple portions having an upper terminal edge extending in a direction along the brow portion and along each of the temple portions, defining an unshielded crown opening extending from the brow portion rearwardly between the temple portions and a rear opening;

a jaw portion extending from each of the temple portions and configured to substantially shield one side the athlete's lower jaw;

the jaw portions being connected to define a front portion which includes an opening sized to permit frontal viewing of the athlete's mouth;

each jaw portion including (a) spaced-apart upper and lower members, the upper member extending between the respective temple portion and front portion and (b) an intermediate member extending between and connecting the upper and lower members, the intermediate member including a ventilation opening therein;

together the brow, jaw and temple portions defining a substantially open vision aperture defined by an edge surrounding the entire vision aperture and sized to provide the athlete with substantially unobstructed forward and peripheral vision;

a separate substantially rigid reinforcement member secured to the mask portion having a perimeter edge designed to surround the entire vision aperture, the reinforcement member allowing the vision aperture to remain open for forward and peripheral viewing free of vision-impairing structures, and including a side extension extending from each side of the vision aperture to a position rearwardly of the vision aperture and over at least a part of each temple portion, wherein the perimeter edge is designed to encompass and reinforce the entire edge of the vision aperture;

a retainer including one or more straps secured to the mask portion and configured to removably retain the mask portion on the athlete's head, the brow portion including a strap slot for securing a helmet portion to the mask portion, the mask portion also including an aperture or a projection for engaging with projection or an aperture of a helmet portion; and the headpiece further comprising a plastic outer layer and a foam inner layer, the plastic outer layer including integral foam retaining anchors extending onto and connecting the foam layer and the plastic layer.

20. The headpiece of claim 19 in which the reinforcing member is positioned in a relief area around the open vision aperture.

* * * * *